US006565800B2

(12) United States Patent
Dunne

(10) Patent No.: US 6,565,800 B2
(45) Date of Patent: May 20, 2003

(54) APPARATUS FOR INJECTING SOLID PARTICULATE MATERIAL INTO A VESSEL

(75) Inventor: Martin Joseph Dunne, West Midland (AU)

(73) Assignee: Technological Resources Pty Ltd, Melbourne (AU)

( * ) Notice: Subject to any disclaimer, the term of this patent is extended or adjusted under 35 U.S.C. 154(b) by 0 days.

(21) Appl. No.: 09/866,481

(22) Filed: May 29, 2001

(65) Prior Publication Data

US 2002/0014725 A1 Feb. 7, 2002

(51) Int. Cl.[7] ..... C21C 5/32
(52) U.S. Cl. ..... 266/225; 266/268
(58) Field of Search ..... 266/225, 268, 266/270

(56) References Cited

U.S. PATENT DOCUMENTS 3,642,060 A * 2/1972 Hlinka ..... 266/225
3,662,447 A * 5/1972 Schweng et al. ..... 266/225
5,377,960 A * 1/1995 Leczo et al. ..... 266/225
5,865,876 A * 2/1999 Watkins et al. ..... 266/225

* cited by examiner

*Primary Examiner*—Scott Kastler
(74) *Attorney, Agent, or Firm*—Miles & Stockbridge P.C.; John C. Kerins

(57) ABSTRACT

An elongate metallurgical lance (27) for injecting solid particulate material into molten material held within a vessel (11) is disclosed. The lance includes a central core tube (31) through which to pass solid particulate material, an annular cooling jacket (32) surrounding the central core tube throughout a substantial part of its length, a coolant inlet means (52), and a coolant outlet means (53). An outer wall of a forward end section of the jacket is formed from a first material which has high heat transfer properties and can withstand external temperatures above 1100° C. for prolonged periods when the jacket is cooled by coolant flow. An outer wall of a body section of the jacket is formed from a second material that maintains its structural properties when exposed to external temperatures above 1100° C. for prolonged periods when the jacket is cooled by coolant flow, whereby the outer wall acts as a structural member that contributes to supporting the lance at these temperatures. The outer wall of the forward end section and the outer wall of the body section are welded together.

23 Claims, 6 Drawing Sheets

APPARATUS FOR INJECTING SOLID PARTICULATE MATERIAL INTO A VESSEL

BACKGROUND OF THE INVENTION

1. Field of the Invention

The present invention provides a metallurgical lance for injecting solid particulate material into a vessel.

One application of the lance is as a means for injecting metallurgical feed material into the molten bath of a vessel in a process (such as a direct smelting process) for producing molten metal.

2. Description of Related Art

A known direct smelting process, which relies on a molten metal layer as a reaction medium, and is generally referred to as the HIsmelt process, is described in International application PCT/AU96/00197 (WO 96/31627) in the name of the applicant.

The HIsmelt process as described in the International application is a molten bath-based direct smelting process which has particular application for producing molten ferrous metal from ferrous feed material (such as ores, partly reduced ores, and metal containing waste streams). The HIsmelt process includes:

(a) forming a bath of molten iron and slag in a vessel;

(b) injecting into the bath:

(i) a metalliferous feed material, typically metal oxides; and (ii) a solid carbonaceous material, typically coal, which acts as a reductant of the metal oxides and a source of energy; and (c) smelting metalliferous feed material to metal in the metal layer.

The term "smelting" is herein understood to mean thermal processing wherein chemical reactions that reduce metal oxides take place to produce liquid metal.

The HIsmelt process also includes post-combusting reaction gases, such as CO and $H_2$, released from the bath in the space above the bath with oxygen-containing gas and transferring the heat generated by the post-combustion to the bath to contribute to the thermal energy required to smelt the metalliferous feed materials.

The HIsmelt process also includes forming a transition zone above the nominal quiescent surface of the bath in which there is a favourable mass of ascending and thereafter descending droplets or splashes or streams of molten metal and/or slag which provide an effective medium to transfer to the bath the thermal energy generated by post-combusting reaction gases above the bath.

In the HIsmelt process the metalliferous feed material and solid carbonaceous material is injected into the metal layer through a number of lances/tuyeres which are inclined to the vertical so as to extend downwardly and inwardly through the side wall of the smelting vessel and into the lower region of the vessel so as to deliver the solids material into the metal layer in the bottom of the vessel. In a commercially operating process the lances must withstand hostile conditions, including operating temperatures of the order of 1400° C., within the smelting vessel for prolonged periods, typically at least several months. The lances must accordingly have an internal forced cooling system to operate successfully in this harsh environment and must be capable of withstanding substantial local temperature variations. The present invention enables the construction of lances that are able to operate effectively under these conditions.

SUMMARY OF THE INVENTION

According to the invention, there is provided an elongate metallurgical lance to extend into a vessel for injecting solid particulate material into molten material held within the vessel, which lance includes:

(a) a central core tube through which to pass the solid particulate material;

(b) an annular cooling jacket surrounding the central core tube throughout a substantial part of its length, which jacket defines an inner elongate annular coolant flow passage disposed about the core tube, an outer elongate annular coolant flow passage disposed about the inner coolant flow passage, and an annular end flow passage interconnecting the inner and outer annular coolant flow passages at a forward end of the jacket;

(c) coolant inlet means for inlet of coolant into the inner annular coolant flow passage of the jacket at a rear end region of the jacket; and (d) coolant outlet means for outlet of coolant from the outer annular coolant flow passage at the rear end region of the jacket, whereby to provide for flow of coolant forwardly along the inner annular coolant flow passage to the forward end of the jacket then through the annular end flow passage and backwardly through the outer annular coolant flow passage, and wherein:

(i) an outer wall of a forward end section of the jacket is formed from a first material which has high heat transfer properties and can withstand external temperatures above 1100° C. for prolonged periods when the jacket is cooled by coolant flow;

(ii) an outer wall of a body section of the jacket is formed from a second material that maintains its structural properties when exposed to external temperatures above 1100° C. for prolonged periods when the jacket is cooled by coolant flow, whereby the outer wall acts as a structural member that contributes to supporting the lance at these temperatures; and (iii) the outer wall of the forward end section and the outer wall of the body section are welded together.

The above-described combination of high heat transfer and structural sections of the lance makes it possible to make the lance relatively long so that;

(a) the entry position of the lance into a vessel that contains a molten bath of metal and slag can be in a side wall of the vessel above the quiescent slag layer, and necessarily above the very hostile hearth region of the vessel; and (b) the lance extends downwardly and inwardly a sufficient distance to deliver feed material into a central portion of the hearth region.

Locating the entry point of the lance in this position, ie above the quiescent slag layer, also makes it possible for the lance to be changed-over if necessary while the vessel still holds molten metal and slag. Thus, lance change-over does not necessitate a major shut-down of the vessel involving draining the vessel.

Preferably the jacket includes a transition section positioned between the outer wall of the forward end section and the outer wall of the body section and the transition section is welded to both outer walls.

Preferably the wall thickness of the outer wall of the body section is less than that of the outer wall of the forward end section.

Preferably the wall thickness at one end of the transition section is substantially the same as that of the outer wall of the forward end section and the wall thickness at the other end of the transition section is substantially the same as that of the body section.

Preferably the temperatures are above 1200° C.

More preferably the temperatures are above 1300° C.

Preferably the first material is copper or a copper alloy.

Preferably the second material is steel.

Preferably the transition section is formed from steel.

Preferably the weld between the forward end section and the transition section is buttered with nickel or a nickel alloy.

Preferably the outer wall of the jacket includes keying formations for solidification of slag onto the outer wall.

Preferably the keying formations have an undercut or dove-tail cross-section.

Preferably the length of the lance that, in use, is self-supporting, is at least 1.5 meters.

Preferably the inner and outer annular coolant flow passages and the annular end flow passage of the jacket are defined by:

(a) an inner tube and an outer tube interconnected at a forward end of the jacket by an annular bullnose end connector to form a single hollow annular structure which is closed at the forward end of the jacket by the annular bullnose end connector; and (b) an elongate tubular structure disposed within the hollow annular structure and having (i) a tube part which extends within it to divide the interior of the hollow annular structure into said inner and outer elongate annular flow passages and (ii) a forward end part disposed adjacent the annular bullnose end connector of said hollow annular structure such that the annular end flow passage is defined between said forward end part of the tubular structure and the annular bullnose end connector of said hollow annular structure.

Preferably the outer tube includes a forward part and a rearward part welded together.

More preferably the forward part of the outer tube defines the outer wall of the forward end section of the jacket that is formed from the first material.

More preferably also the rearward part of the outer tube defines the outer wall of the body section of the jacket that is formed from the second material.

More preferably the outer tube includes the transition section positioned between and welded to the forward and rearward parts.

More preferably the bullnose end connector is formed from the first material.

Preferably the forward end part and the tube part of the elongate tubular structure are welded together.

Preferably the bullnose end connector is welded to each of the inner tube and the outer tube.

Preferably the weld connections between the following components of the jacket are axially spaced to facilitate assembly of the jacket:

(i) the bullnose end connector and the inner tube;

(ii) the bullnose end connector and the outer tube; and (iii) the forward end part and the tube part.

Preferably the core tube includes a nozzle that has one part that is located partially within and is shielded by the cooling jacket and another part that extends beyond the cooling jacket, and the nozzle has a threaded rear end that engages a complementary threaded section of the core tube so that the nozzle can be readily attached and detached from the core tube.

Preferably the annular end flow passage curves smoothly outwardly and backwardly from the inner annular coolant flow passage to the outer annular coolant flow passage and the effective cross-sectional area for water flow through the annular end flow passage is less than the cross-sectional flow areas of both the inner and outer annular coolant flow passages.

Preferably further the single hollow annular structure is mounted so as to permit relative longitudinal movement between the inner and outer tubes thereof due to differential thermal expansion or contraction thereof and the elongate tubular structure is mounted to accommodate that movement.

Preferably the coolant is water.

According to the present invention there is also provided a vessel for operating a molten bath-based process for smelting ferrous feed material to produce molten ferrous metal which includes a hearth, a side wall extending upwardly from the hearth, and at least one of the above-described metallurgical lance extending through the side wall and into the vessel.

Preferably the dimensions of the lance are selected such that the lance extends at least 1.5 meters into the vessel and is self-supporting over that length.

Preferably the self-supporting length of the lance is at least 2.5 meters.

Preferably the lance extends downwardly through the side wall of the vessel into a hearth region of the vessel at an angle of 30 to 60° to the horizontal.

Preferably the side wall includes a section formed from water-cooled panels and the lance extends through that section.

In order that the invention may be more fully explained, one particular embodiment will be described with reference to the accompanying drawings in which:

DETAILED DESCRIPTION OF THE PREFERRED EMBODIMENTS

Figure 1:
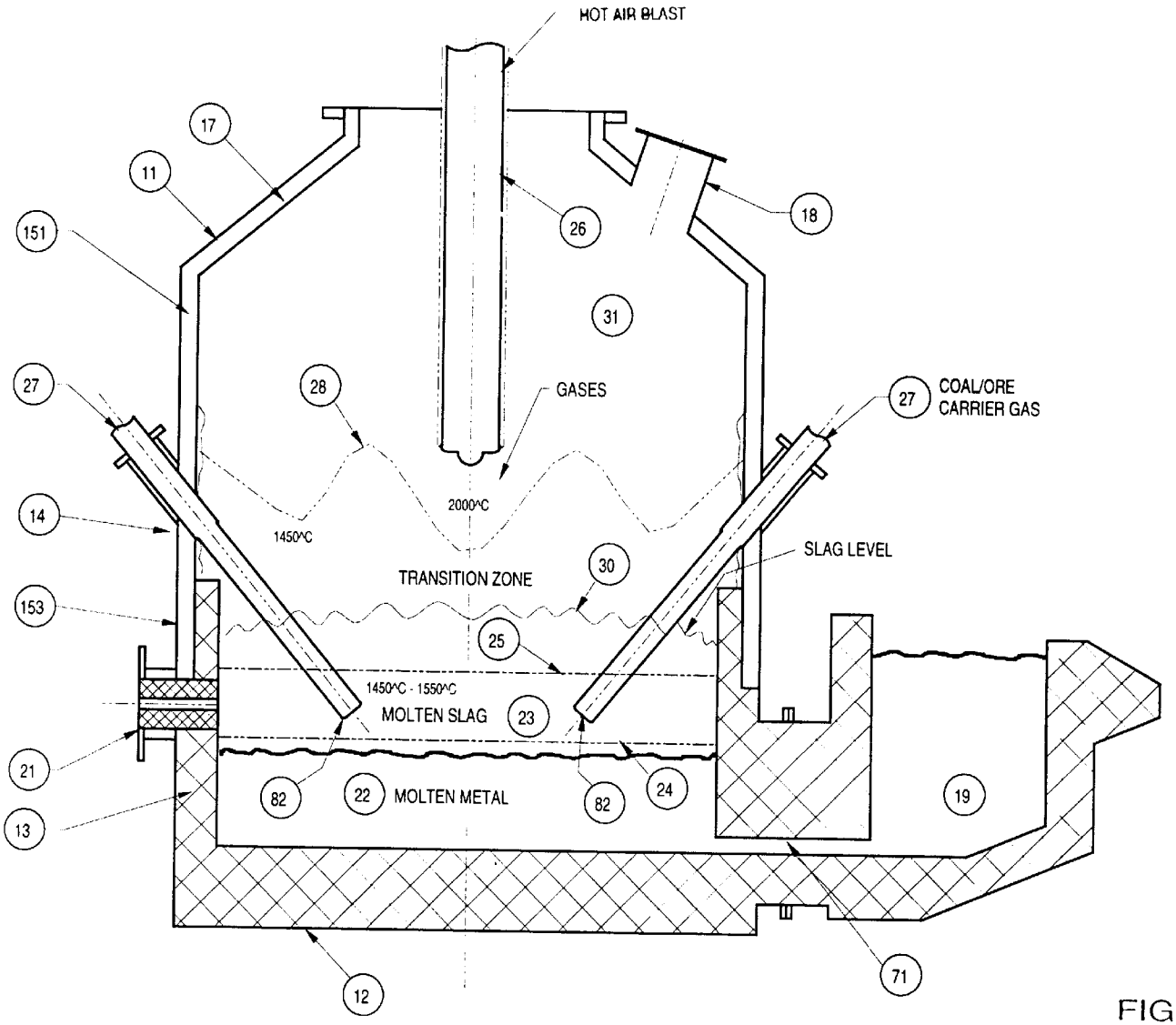
FIG. 1 is a vertical section through a metallurgical vessel incorporating a pair of solids injection lances constructed in accordance with the invention.

FIG. 1 illustrates a direct smelting vessel suitable for operating the HIsmelt process as described in International Patent Application PCT/AU96/00197 and the disclosure in the International application is incorporated herein by cross-reference. The following description is in the context of smelting iron ore to produce molten iron.

With reference to the Figures, the metallurgical vessel is denoted generally as 11 and has a hearth that includes a base 12 and sides 13 formed from refractory bricks; side walls 14 which form a generally cylindrical barrel extending upwardly from the sides 13 of the hearth and which includes an upper barrel section 151 formed from water cooled panels and a lower barrel section 153 formed from water cooled panels and an inner lining of refractory bricks; a roof 17; an outlet 18 for off-gases; a forehearth 19 for discharging molten metal continuously; and a tap-hole 21 for discharging molten slag.

In use, the vessel contains a molten bath of iron and slag which, under quiescent conditions, includes a layer 22 of molten metal and a layer 23 of molten slag on the metal layer 22. The term "metal layer" is understood herein to mean a region of the bath that is predominantly metal. The term "slag layer" is understood herein to mean a region of the bath that is predominantly slag. The arrow marked by the numeral 24 indicates the position of the nominal quiescent surface of the metal layer 22 and the arrow marked by the numeral 25 indicates the position of the nominal quiescent surface of the slag layer 23 (ie of the molten bath). The term "quiescent surface" is understood to mean the surface when there is no injection of gas and solids into the vessel.

The vessel is fitted with a downwardly extending hot air injection lance 26 for delivering a hot air blast into an upper region of the vessel.

The vessel is also fitted with solids injection lances 27 (two shown) extending downwardly and inwardly through the side walls 14 and into the slag layer 23 for injecting iron ore, solid carbonaceous material, and fluxes entrained in an oxygen-deficient carrier gas into the molten bath. The position of the lances 27 is selected so that their entry points are above the quiescent surface 25 of the slag layer 23 and their outlet ends 28 are above the surface of the metal layer 22 during operation of the process. This position of the lances reduces the risk of damage through contact with molten metal and also makes it possible to cool the lances by forced internal water cooling without significant risk of water coming into contact with the molten metal in the vessel. The lances 27 extend at least 1.5 meters into the vessel at an angle of 30° to 60° to the horizontal and are self-supporting over that length. The construction of the solids injection lances is illustrated in detail in FIGS. 2 to 6.

In use of the vessel to operate the HIsmelt process, iron ore, solid carbonaceous material (typically coal), and fluxes (typically lime and magnesia) entrained in a carrier gas (typically $N_2$) are injected into the molten bath via the lances 27. The momentum of the solid material/carrier gas causes the solid material and gas to penetrate to a lower region of the molten bath. The injection of the solid material and the carrier gas causes buoyancy uplift of molten metal, solid carbon and slag which in turn causes substantial agitation in the molten bath, with the result that the molten bath expands in volume and has a surface indicated by the arrow 30. The extent of agitation is such that there is reasonably uniform temperature throughout the molten bath—typically, 1450°–1550° C. In addition, upward movement of splashes, droplets and streams of molten material caused by the buoyancy uplift of molten metal, solid carbon, and slag extends into the top space 31 above the molten bath in the vessel and:

(a) forms a transition zone 28; and (b) projects some molten material (predominantly slag) beyond the transition zone 28 and onto the part of the upper barrel section 151 of the side walls 14 that is above the transition zone 28 and onto the roof 17.

The expanded molten bath and the transition zone 28 define a raised bath.

In addition to the above, a hot air blast at a temperature of 800–1400° C. via the lance 26 post-combusts reaction gases CO and $H_2$ in the transition zone 28 and generates high temperatures of the order of 2000° C. or higher in the gas space. The heat is transferred to the ascending and descending splashes droplets, and streams, of molten material in the region of gas injection and the heat is then partially transferred throughout the molten bath.

With reference to FIGS. 2 to 6, each solids injection lance 27 includes a central core tube 31 through which to deliver the solids material and an annular cooling jacket 32 surrounding the central core tube 31 throughout a substantial part of its length.

Figure 4:
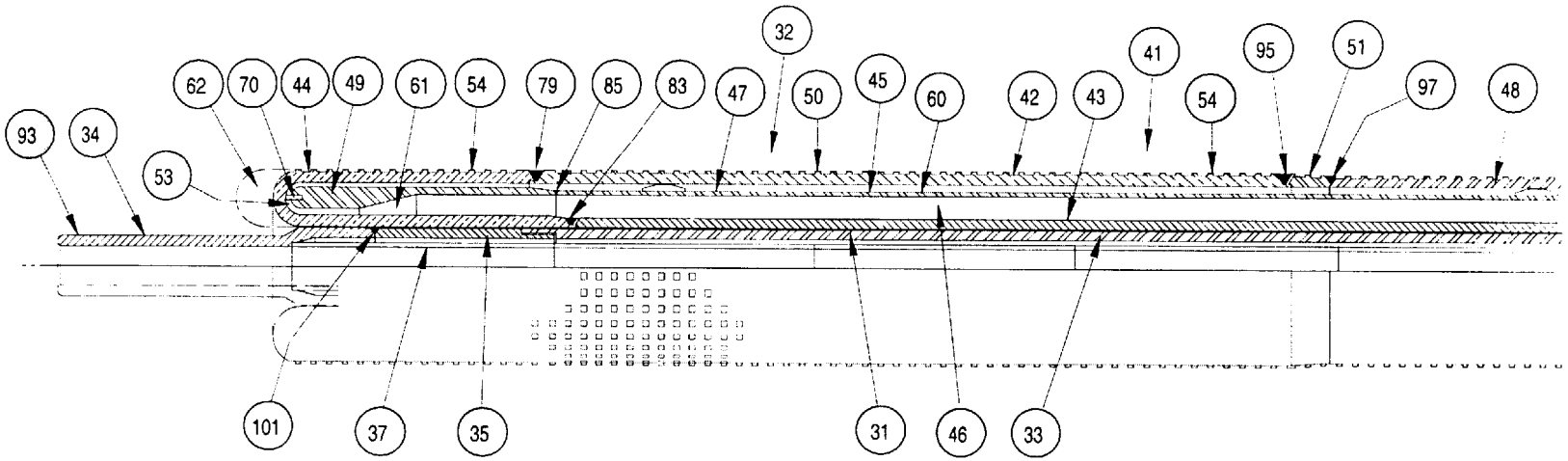
FIG. 4 is an enlarged cross-section through the forward end of the lance.
Figure 5:
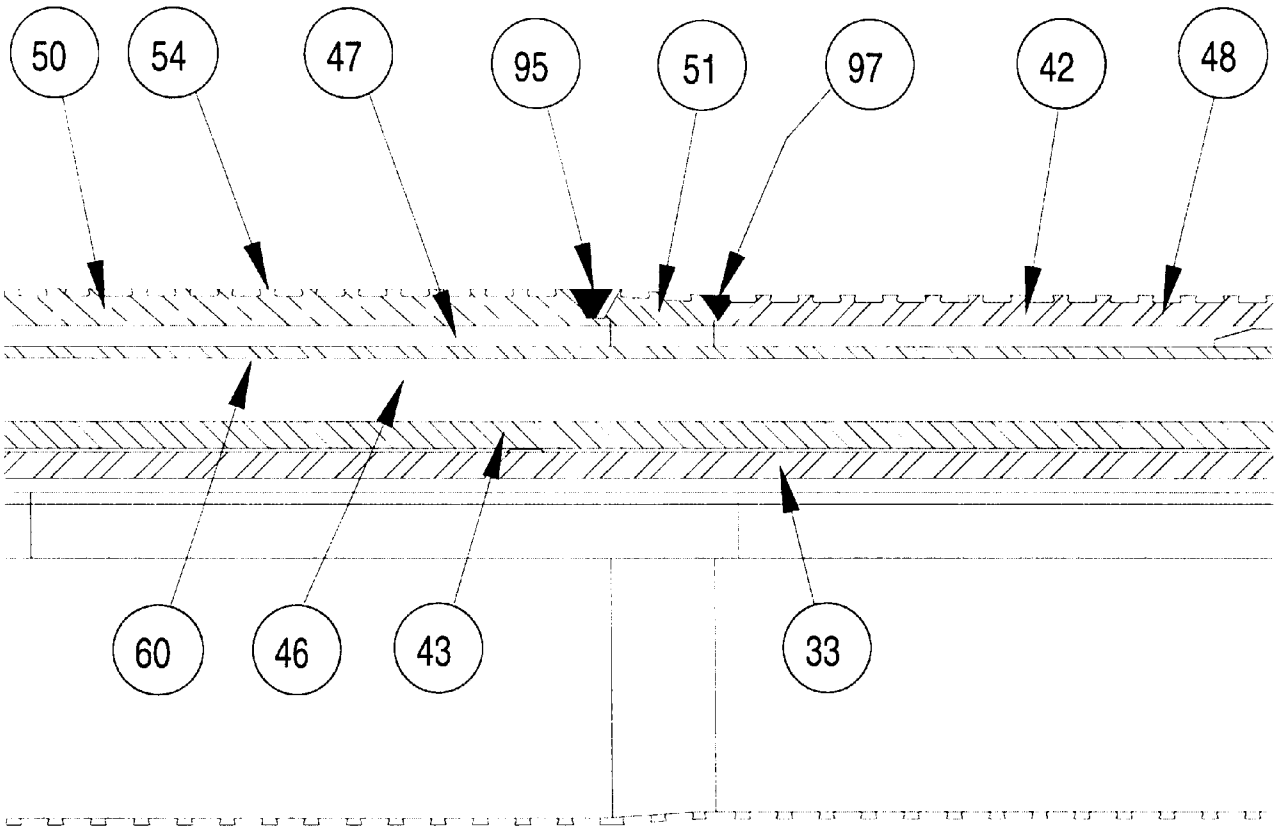
FIG. 5 is an enlarged cross-section of a part of the forward end of the lance which illustrates the transition section of the jacket.

With particular reference to FIG. 4, central core tube 31 is formed of steel tubing 33 throughout most of its length. Central core tube 31 also includes a stainless steel section 34 at its forward end that forms a nozzle that projects beyond the forward end of cooling jacket 32. The forward end part 34 of core tube 31 includes a forward section 93 and an adaptor section 35 which are welded together at weld 101. The forward end part 34 is connected to the tubing 33 through a screw thread 36 formed on both the adaptor section 35 and the tubing 33. This arrangement makes it possible to readily replace the forward end section 34.

Central core tube 31 is internally lined through to the forward end part 34 with a thin ceramic lining 37 formed by a series of cast ceramic tubes. As can best be seen in FIG. 3, the rear end of the central core tube 31 is connected through a coupling 38 to a T-piece 39 through which particulate solids material is delivered in a pressurised fluidising gas carrier, for example nitrogen.

Figure 2A:
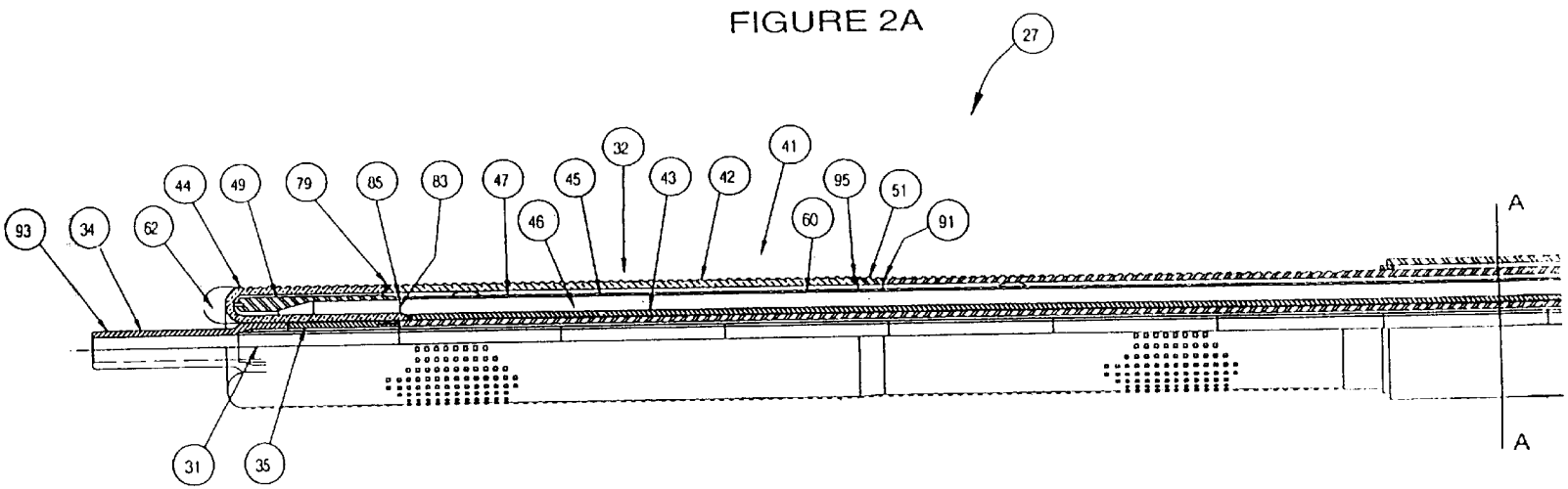
FIGS. 2A and 2B join on the line A—A to form a longitudinal cross-section through one of the solids injection lances.
Figures 2B, 6:
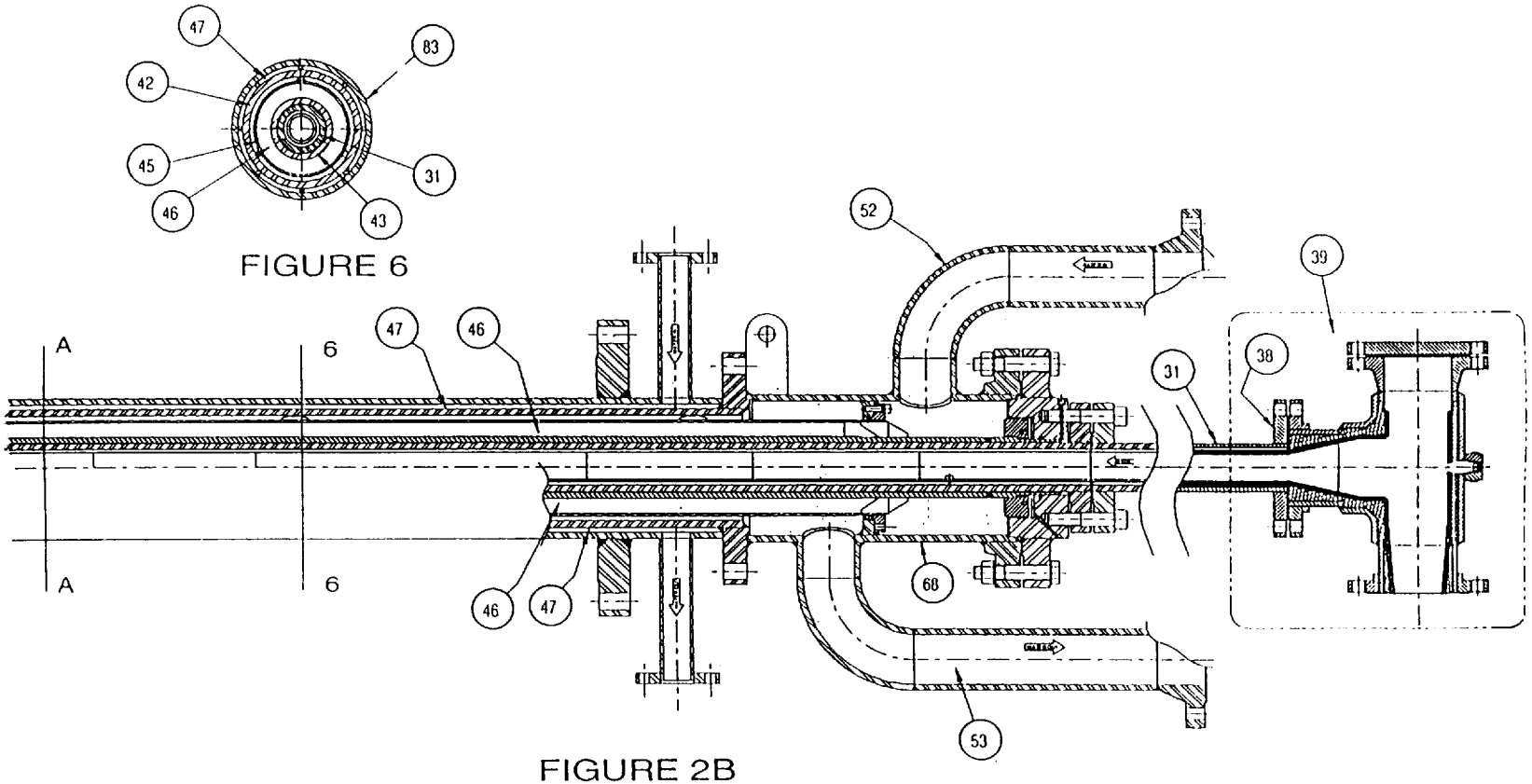
FIG. 6 is an enlarged transverse cross-section on the line 6—6 in FIG. 2B.
Figure 3:
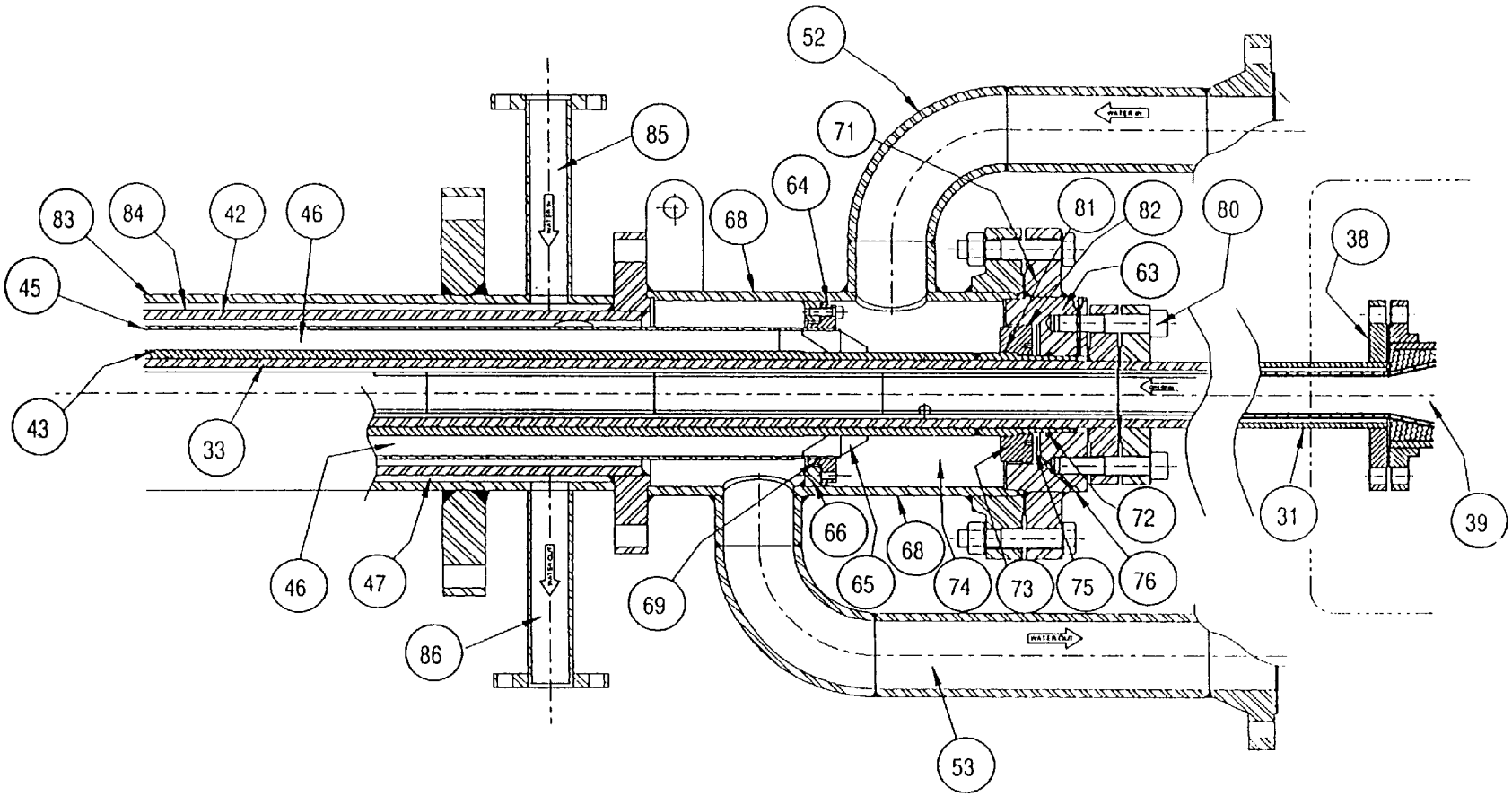
FIG. 3 is an enlarged longitudinal cross-section through a rear end of the lance.

With reference initially to FIG. 2A, annular cooling jacket 32 includes a long hollow annular structure 41 comprised of outer and inner tubes 42, 43 interconnected by a bullnose front end connector piece 44 and an elongate tubular structure 45 which is disposed within the hollow annular structure 41 so as to divide the interior of structure 41 into an inner elongate annular water flow passage 46 and an outer elongate annular water flow passage 47.

With particular reference to FIG. 4, front end connector 44 of jacket 32 is hand machined from a solid hot forged copper billet. The materials selection for the connector 44 is based on providing high heat transfer at operating temperatures above 1300° C.

Outer and inner tubes 42, 43 are typically at least 2 meters long. Inner tube 43 is formed from steel and is welded at a forward end to front end connector 44 at weld 83. Outer tube 42 is in two main parts, a forward part 50 and a rearward part 48, and includes a transition part 51 positioned between and welded to the two main parts at welds 95, 97. The forward part 50 is formed from copper, the rearward part 48 and the transition part 51 are formed from steel. The weld 95 between the forward part 50 and the transition part 51 is buttered with nickel or a nickel alloy. The buttering step includes preheating the parts to be welded to 600° C. The forward part 50 is welded to the front end connector 44 at weld 79. The section of the lance that is forward of the transition part 51 is a forward end section of the lance and the transition section 51 and the section of the lance that is rearward of the transition piece 51 is a body section of the lance. The materials selection for the inner tube 43 and the rearward part 48 of the outer tube 42 is based on maintaining structural integrity of the lance when exposed to temperatures above 1300° C. in the vessel. Accordingly, the main consideration for the materials selection for these components is performance of the components as structural members. The materials selection for the forward part 50 of the outer tube 42 is based on providing high heat transfer at operating temperatures above 1300° C. In order to meet performance requirements the wall thickness of the forward part 50 is greater than that of the rearward part 48. Transition section 51 is formed with a wall thickness that decreases from the end that is welded to forward part 50 to the other end that is welded to rearward part 48.

Elongate tubular structure 45 is formed by a long steel tube 60 welded at weld 85 to a machined steel forward end piece 49 which fits within the front end connector 44 of the hollow tubular structure 41 to form an annular end flow passage 53 which interconnects the forward ends of the inner and outer water flow passages 46, 47.

As can best be seen in FIG. 4, welds 79, 83 and 85 are axially offset to facilitate construction of jacket 32. The arrangement is such that the components of jacket 32 are assembled together by first welding together front end connector 44 and inner tube 43 and forming weld 83. The next steps are to connect forward end piece 49 to front end connector 44 via a series of circumferentially spaced dowels 70 and then to weld tube 60 to forward end piece 49. Locating resultant weld 85 axially forward of weld 83 minimises heat effects on the already-formed weld 83 when forming weld 85. The final step is to weld outer tube 42 (which has previously been assembled by welding together forward part 50, transition part 51, and rearward part 48) to front end connector 44. Again, locating resultant weld 79 axially forward of weld 85 minimises heat effects on the already-formed weld 85 when forming weld 79.

The rear end of annular cooling jacket 32 is provided with a water inlet 52 through which the flow of cooling water can be directed into the inner annular water flow passage 46 and a water outlet 53 from which water is extracted from the outer annular passage 47 at the rear end of the lance. Accordingly, in use of the lance, cooling water flows forwardly down the lance through the inner annular water flow passage 46 then outwardly and back around the forward annular end passage 51 into the outer annular passage 47 through which it flows backwardly along the lance and out through the outlet 53. This ensures that the coolest water is in heat transfer relationship with the incoming solids material to ensure that this material does not melt or burn before it discharges from the forward end of the lance and enables effective cooling of both the solids material being injected through the central core of the lance as well as effective cooling of the forward end and outer surfaces of the lance.

The outer surfaces of the tube 42 and front end piece 44 of the hollow annular structure 41 are machined with a regular pattern of rectangular projecting bosses 54 each having an undercut or dove tail cross-section so that the bosses serve as keying formations for solidification of slag on the outer surfaces of the lance. Solidification of slag on to the lance assists in minimising the temperatures in the metal components of the lance. It has been found in use that slag freezing on the forward or tip end of the lance serves as a base for formation of an extended pipe of solid material serving as an extension of the lance which further protects exposure of the metal components of the lance to the severe operating conditions within the vessel.

It has been found that it is important to cooling of the tip end of the lance to maintain a high water flow velocity around the annular end flow passage 51. In particular it is most desirable to maintain a water flow velocity in this region of the order of 10 meters per second to obtain maximum heat transfer. In order to maximise the water flow rate in this region, the effective cross-section for water flow through passage 51 is significantly reduced below the effective cross-section of both the inner annular water flow passage 46 and the outer water flow passage 47. Forward end piece 49 of the inner tubular structure 45 is shaped and positioned so that water flowing from the forward end of inner annular passage 46 passes through an inwardly reducing or tapered nozzle flow passage section 61 to minimise eddies and losses before passing into the end flow passage 53. The end flow passage 53 also reduces in effective flow area in the direction of water flow so as to maintain the increased water flow velocity around the bend in the passage and back to the outer annular water flow passage 47. In this manner, it is possible to achieve the necessary high water flow rates in the tip region of the cooling jacket without excessive pressure drops and the risk of blockages in other parts of the lance.

In order to maintain the appropriate cooling water velocity around the tip end passage 51 and to minimise heat transfer fluctuations, it is important to maintain a constant controlled spacing between the front end piece 49, tubular structure 45 and the end piece 44 of the hollow annular structure 41. This presents a problem due to differential thermal expansion and contraction in the components of the lance. In particular, the outer tube 42 of hollow annular structure 41 is exposed to much higher temperatures than the inner tube 43 of that structure and the forward end of that structure therefore tends to roll forwardly in the manner indicated by the dotted line 62 in FIG. 4. This produces a tendency for the gap between components 44, 49 defining the passage 53 to open when the lance is exposed to the operating conditions within the smelting vessel. Conversely, the passage can tend to close if there is a drop in temperature during operation. In order to overcome this problem the rear end of the inner tube 43 of hollow annular structure 41 is supported in a sliding mounting 63 so that it can move axially relative to the outer tube 42 of that structure, the rear end of inner tubular structure 45 is also mounted in a sliding mounting 64 and is connected to the inner tube 43 of structure 41 by a series of circumferentially spaced connector cleats 65 so that the tubes 43 and 45 can move axially together. In addition, the end pieces 44, 49 of the hollow annular structure 41 and tubular structure 45 are positively interconnected by circumferentially spaced dowels 70 to maintain the appropriate spacing under both thermal expansion and contraction movements of the lance jacket.

The sliding mounting 64 for the inner end of tubular structure 45 is provided by a ring 66 attached to a water flow manifold structure 68 which defines the water inlet 52 and outlet 53 and is sealed by an O-ring seal 69. The sliding mounting 63 for the rear end of the inner tube 43 of structure 41 is similarly provided by a ring flange 71 fastened to the water manifold structure 68 and is sealed by an O-ring seal 72. An annular piston 73 is located within ring flange 71 and connected by a screw thread connection 80 to the back end of the inner tube 43 of structure 41 so as to close a water inlet manifold chamber 74 which receives the incoming flow of cooling from inlet 52. Piston 73 slides within hardened surfaces on ring flange 71 and is fitted with O-rings 81, 82. The sliding seal provided by piston 73 not only allows movements of the inner tube 43 due to differential thermal expansion of structure 41 but it also allows movement of tube 43 to accommodate any movement of structure 41 generated by excessive water pressure in the cooling jacket. If for any reason the pressure of the cooling water flow becomes excessive, the outer tube of structure 41 will be forced outwardly and piston 73 allows the inner tube to move accordingly to relieve the pressure build up. An interior space 75 between the piston 73 and the ring flange 71 is vented through a vent hole 76 to allow movement of the piston and escape of water leaking past the piston.

The rear part of annular cooling jacket 32 is provided with an outer stiffening pipe 83 part way down the lance and defining an annular cooling water passage 84 through which a separate flow of cooling water is passed via a water inlet 85 and water outlet 86.

Typically cooling water will be passed through the cooling jacket at a flow rate of 100 $m^3$/Hr at a maximum operating pressure of 800 kPa to produce water flow velocities of 10 meters/minute in the tip region of the jacket. The inner and outer parts of the cooling jacket can be subjected to temperature differentials of the order of 200° C. and the movement of tubes 42 and 45 within the sliding mountings 63, 64 can be considerable during operation of the lance, but the effective cross-sectional flow area of the end passage 51 is maintained substantially constant throughout all operating conditions.

Although the illustrated lance has been designed for injection of solids into a direct reduction smelting vessel, it will be appreciated that similar lances may be used for introducing solid particulate material into any metallurgical vessel or induced any vessel in which high temperature conditions prevail. It is accordingly to be understood that this invention is in no way limited to the details of the illustrated construction and that many modifications and variations will fall within the spirit and scope of the invention.

What is claimed is:

1. An elongate metallurgical lance to extend into a vessel for injecting solid particulate material into molten material held within the vessel, which lance includes:

(a) a central core tube through which to pass the solid particulate material;

(b) an annular cooling jacket surrounding the central core tube throughout a substantial part of its length, which jacket defines an inner elongate annular coolant flow passage disposed about the core tube, an outer elongate annular coolant flow passage disposed about the inner coolant flow passage, and an annular end flow passage interconnecting the inner and outer annular coolant flow passages at a forward end of the jacket;

(c) coolant inlet means for inlet of coolant into the inner annular coolant flow passage of the jacket at a rear end region of the jacket; and (d) coolant outlet means for outlet of coolant from the outer annular coolant flow passage at the rear end region of the jacket, whereby to provide for flow of coolant forwardly along the inner annular coolant flow passage to the forward end of the jacket then through the annular end flow passage and backwardly through the outer annular coolant flow passage, and wherein:

(i) the annular cooling jacket comprises outer and inner tubes interconnected by a front end connector piece made of copper or copper alloy;

(ii) the outer tube has a forward end section formed from a first material which has high heat transfer properties and can withstand external temperatures above 1100° C. for prolonged periods when the jacket is cooled by coolant flow, said forward end of said outer tube being welded to the front end connector piece;

(iii) the outer tube has a body section formed from a second material that maintains its structural properties when exposed to external temperatures above 1100° C. for prolonged periods when the jacket is cooled by coolant flow, whereby the body section of the outer tube acts as a structural member that contributes to supporting the lance at these temperatures; and (iv) the forward end section and the body section of the outer tube are welded together.

2. The lance defined in claim 1 wherein the outer tube includes a transition section positioned between the forward end section and the body section and the transition section is welded to both the forward end section and the body section of the outer tube.

3. An elongate metallurgical lance to extend into a vessel for injecting solid particulate material into molten material held within the vessel, which lance includes:

(a) a central core tube through which to pass the solid particulate material;

(b) an annular cooling jacket surrounding the central core tube throughout a substantial part of its length, which jacket defines an inner elongate annular coolant flow passage disposed about the core tube, an outer elongate annular coolant flow passage disposed about the inner coolant flow passage, and an annular end flow passage interconnecting the inner and outer annular coolant flow passages at a forward end of the jacket;

(c) coolant inlet means for inlet of coolant into the inner annular coolant flow passage of the jacket at a rear end region of the jacket; and (d) coolant outlet means for outlet of coolant from the outer annular coolant flow passage at the rear end region of the jacket, whereby to provide for flow of coolant forwardly along the inner annular coolant flow passage to the forward end of the jacket then through the annular end flow passage and backwardly through the outer annular coolant flow passage, and wherein:

(i) an outer wall of a forward end section of the jacket is formed from a first material which has high heat transfer properties and can withstand external temperatures above 1100° C. for prolonged periods when the jacket is cooled by coolant flow;

(ii) an outer wall of a body section of the jacket is formed from a second material that maintains its structural properties when exposed to external temperatures above 1100° C. for prolonged periods when the jacket is cooled by coolant flow, whereby the outer wall acts as a structural member that contributes to supporting the lance at these temperatures; and (iii) the outer wall of the forward end section and the outer wall of the body section are welded together, wherein the jacket includes a transition section positioned between the outer wall of the forward end section and the outer wall of the body section and the transition section is welded to both outer walls, and wherein the wall thickness of the outer wall of the body section is less than that of the outer wall of the forward end section.

4. The lance defined in claim 3 wherein the wall thickness at one end of the transition section is substantially the same as that of the outer wall of the forward end section and the wall thickness at the other end of the transition section is substantially the same as that of the body section.

5. The lance defined in claim 4 wherein the first material is copper or a copper alloy.

6. The lance defined in claim 5 wherein the second material is steel.

7. The lance defined in claim 2 wherein the transition section is formed from steel.

8. An elongate metallurgical lance to extend into a vessel for injecting solid particulate material into molten material held within the vessel, which lance includes:

(a) a central core tube through which to pass the solid particulate material;

(b) an annular cooling jacket surrounding the central core tube throughout a substantial part of its length, which jacket defines an inner elongate annular coolant flow passage disposed about the core tube, an outer elongate annular coolant flow passage disposed about the inner coolant flow passage, and an annular end flow passage interconnecting the inner and outer annular coolant flow passages at a forward end of the jacket;

(c) coolant inlet means for inlet of coolant into the inner annular coolant flow passage of the jacket at a rear end region of the jacket; and (d) coolant outlet means for outlet of coolant from the outer annular coolant flow passage at the rear end region of the jacket, whereby to provide for flow of coolant forwardly along the inner annular coolant flow passage to the forward end of the jacket then through the annular end flow passage and backwardly through the outer annular coolant flow passage, and wherein:

(i) an outer wall of a forward end section of the jacket is formed from a first material which has high heat transfer properties and can withstand external temperatures above 1100° C. for prolonged periods when the jacket is cooled by coolant flow;

(ii) an outer wall of a body section of the jacket is formed from a second material that maintains its structural properties when exposed to external temperatures above 1100° C. for prolonged periods when the jacket is cooled by coolant flow, whereby the outer wall acts as a structural member that contributes to supporting the lance at these temperatures; and (iii) the outer wall of the forward end section and the outer wall of the body section are welded together;

wherein the jacket includes a transition section positioned between the outer wall of the forward end section and the outer wall of the body section and the transition section is welded to both outer walls, and wherein the weld between the forward end section and the transition section is buttered with nickel or a nickel alloy.

9. The lance defined in claim 1 wherein the lance is of a length such that, in use installed in a vessel, the lance is self-supporting and is at least 1.5 meters in length.

10. The lance defined claim 1 wherein the inner and outer annular coolant flow passages and the annular end flow passage of the jacket are defined by:

(a) the inner tube and the outer tube being interconnected at a forward end of the jacket by the front end connector piece, to form a single hollow annular structure which is closed at the forward end of the jacket; and (b) an elongate tubular structure disposed within the hollow annular structure and having (i) a tube part which extends within it to divide the interior of the hollow annular structure into said inner and outer elongate annular flow passages and (ii) a forward end part disposed adjacent the front end connector piece of said hollow annular structure such that the annular end flow passage is defined between said forward end part of the tubular structure and the front end connector piece of said hollow annular structure.

11. An elongate metallurgical lance to extend into a vessel for injecting solid particulate material into molten material held within the vessel, which lance includes:

(a) a central core tube through which to pass the solid particulate material;

(b) an annular cooling jacket surrounding the central core tube throughout a substantial part of its length, which jacket defines an inner elongate annular coolant flow passage disposed about the core tube, an outer elongate annular coolant flow passage disposed about the inner coolant flow passage, and an annular end flow passage interconnecting the inner and outer annular coolant flow passages at a forward end of the jacket;

(c) coolant inlet means for inlet of coolant into the inner annular coolant flow passage of the jacket at a rear end region of the jacket; and (d) coolant outlet means for outlet of coolant from the outer annular coolant flow passage at the rear end region of the jacket, whereby to provide for flow of coolant forwardly along the inner annular coolant flow passage to the forward end of the jacket then through the annular end flow passage and backwardly through the outer annular coolant flow passage, and wherein:

(i) an outer wall of a forward end section of the jacket is formed from a first material which has high heat transfer properties and can withstand external temperatures above 1100° C. for prolonged periods when the jacket is cooled by coolant flow;

(ii) an outer wall of a body section of the jacket is formed from a second material that maintains its structural properties when exposed to external temperatures above 1100° C. for prolonged periods when the jacket is cooled by coolant flow, whereby the outer wall acts as a structural member that contributes to supporting the lance at these temperatures; and (iii) the outer wall of the forward end section and the outer wall of the body section are welded together, wherein the inner and outer annular coolant flow passages and the annular end flow passage of the jacket are defined by:

(a) an inner tube and an outer tube interconnected at a forward end of the jacket by an annular bullnose end connector to form a single hollow annular structure which is closed at the forward end of the jacket by the annular bullnose end connector; and (b) an elongate tubular structure disposed within the hollow annular structure and having (i) a tube part which extends within it to divide the interior of the hollow annular structure into said inner and outer elongate annular flow passages and (ii) a forward end part disposed adjacent the annular bullnose end connector of said hollow annular structure such that the annular end flow passage is defined between said forward end part of the tubular structure and the annular bullnose end connector of said hollow annular structure, wherein the outer tube includes a forward part and a rearward part welded together, wherein the forward part of the outer tube defines the outer wall of the forward end section of the jacket that is formed from the first material, wherein the rearward part of the outer tube defines the outer wall of the body section of the jacket that is formed from the second material, and wherein the outer tube includes the transition section positioned between and welded to the forward and rearward parts.

12. The lance defined in claim 11, wherein the bullnose end connector is formed from the first material.

13. The lance defined in claim 12 wherein the forward end part and the tube part of the elongate tubular structure are welded together.

14. The lance defined in claim 13 wherein the bullnose end connector is welded to each of the inner tube and the outer tube.

15. The lance defined in claim 14 wherein the weld connections between the following components of the jacket are axially spaced to facilitate assembly of the jacket:

(i) the bullnose end connector and the inner tube;

(ii) the bullnose end connector and the outer tube; and (iii) the forward end part and the tube part.

16. A vessel for operating a molten bath-based process for smelting ferrous feed material to produce molten ferrous metal which includes a hearth, a side wall extending upwardly from the hearth, and at least one metallurgical lance extending through the side wall and into the vessel, said at least one metallurgical lance being constructed in accordance with claim 1, and wherein the lance extends at least 1.5 meters into the vessel and is self-supporting over that length.

17. The vessel defined in claim 16 wherein the self-supporting length of the lance is at least 2.5 meters.

18. The vessel defined in claim 16 wherein the lance extends downwardly through the side wall of the vessel into the hearth region of the vessel at an angle of 30° to 60° to the horizontal.

19. The lance defined in claim 2 wherein the wall thickness of the body section of the outer tube is less than that of the forward end section of the outer tube.

20. The lance defined in claim 3 wherein the wall thickness at one end of the transition section is substantially the same as that of the forward end section of the outer tube and the wall thickness at the other end of the transition section is substantially the same as that of the body section of the outer tube.

21. The lance defined claim 2 wherein the first material is copper or a copper alloy.

22. The lance defined in claim 21 wherein the second material is steel.

23. The lance defined in claim 22 wherein the transition section is formed from steel.

* * * * *